United States Patent [19]

Lenz

[11] Patent Number: 4,913,363

[45] Date of Patent: Apr. 3, 1990

[54] METHOD FOR WINDING TEXTILE YARNS

[75] Inventor: Friedhelm Lenz, Wuppertal, Fed. Rep. of Germany

[73] Assignee: Barmag AG, Remscheid, Fed. Rep. of Germany

[21] Appl. No.: 9,252

[22] Filed: Jan. 30, 1987

[30] Foreign Application Priority Data

Jan. 31, 1986 [DE] Fed. Rep. of Germany ..... 3602853
Mar. 18, 1986 [DE] Fed. Rep. of Germany ..... 2608816
May 15, 1986 [DE] Fed. Rep. of Germany ..... 3616362

[51] Int. Cl.[4] ..... B65H 54/32; B65H 54/38

[52] U.S. Cl. ..... 242/18.1; 242/43 R; 242/43.1

[58] Field of Search ..... 242/18.1, 43 R, 43.1

[56] References Cited

U.S. PATENT DOCUMENTS 3,730,448 5/1973 Schippers et al. ..... 242/18.1 X
4,325,517 4/1982 Schippers et al. ..... 242/18.1
4,498,637 2/1985 Yamamoto et al. ..... 242/18.1
4,659,027 4/1987 Schippers et al. ..... 242/18.1

FOREIGN PATENT DOCUMENTS 1710137 10/1971 Fed. Rep. of Germany .
2112029 7/1983 United Kingdom .
2157725 4/1985 United Kingdom .

OTHER PUBLICATIONS

German Industrial Standards (DIN) 61800, May 1973, 5 pages.

*Primary Examiner*—Stanley N. Gilreath
*Attorney, Agent, or Firm*—Bell, Seltzer, Park & Gibson

[57] ABSTRACT

A method for winding a textile yarn into a package is disclosed, and which is characterized by the ability to produce relatively large packages which are adapted to permit a high speed unwinding by withdrawal of the yarn over one end of the package. The method involves controlling the yarn traverse guide so as to include stroke modification cycles durin which the traverse stroke is progressively increased in length and then decreased, and such that a plot of the location of the stroke end points vs. time defines a parabola-like, arcuate curve. The exact shape of the curve is designed so as to produce a cylindrical wind in the end area, which is slightly greater in diameter than the diameter of the medial portion of the package. In addition, the traversing speed of the yarn guide and the circumferential speed of the package may be constantly accelerated and decelerated to avoid undesirable patterns, with the changes in speed being coordinated with the stroke modification cycles to provide a uniform yarn tension in the package.

13 Claims, 9 Drawing Sheets

METHOD FOR WINDING TEXTILE YARNS

BACKGROUND OF THE INVENTION

The present invention relates to the winding of textile yarns into core supported packages, and more particularly the random winding of a cylindrical cross wound package of a textured yarn, such as a false twist textured filament yarn. In such winding operations, the end faces of the cylindrical package may lie in a normal plane (winding with straight end faces), or the end faces may be inclined relative to this normal plane (biconical winding).

A randomly cross wound package in the context of the present invention is a cross wound package having a winding ratio which constantly varies during the course of the winding cycle. The "winding ratio" is here understood to mean the ratio of the package speed (revolutions of the package per minute) to the traversing speed (number of double strokes per minute). Packages of the described type are described in DIN No. 61800 (German Industrial Standards), and they are commonly produced on the winding systems of yarn texturing machines. In such machines, the yarns receive crimp-elastic properties from their treatment, in particular the false twist texturing operation.

It is known that the end areas on the peripheral surface of cross wound packages often include bulges which result from an unavoidable deposit of an unduly large quantity of yarn in the area of stroke reversal. In order to avoid such bulges at the package ends, it is known to periodically modify the traverse stroke, by a periodic shortening and lengthening of the stroke in the area of these bulges. It is also known that pattern or ribbon breaking steps should be employed in the production of cross wound packages. A ribbon may be described as an appearance on the package, where in successively wound layers of the yarn, uni-directional yarn lengths more or less overlie each other. Such ribbons are normally avoided in that the traverse speed, which is expressed as the number of reciprocal movements (double strokes) of the traversing yarn guide, is decreased and increased between an upper and a lower limit.

It is also known that the tension at which the yarn is wound on the package, is an important factor for good unwinding properties. In particular, it is important that the tension be uniform over the yarn length and the length of the package. To ensure a uniform yarn tension, it is known that a stroke modification and a pattern breaking may occur simultaneously in such a manner that changes of the traverse speed which result from changes of the stroke of the traversing yarn guide, are compensated for by the changes which are caused for the purpose of breaking a pattern.

From investigations as to the unwinding behavior of packages, it has surprisingly been found that a flattening of the cylindrical surface area of the cross wound package on the end opposite to the unwinding end of the package, results in substantially improved unwinding properties of the yarn. In this regard, such packages are commonly mounted on a creel, with the yarns being withdrawn in an axial direction over one end of the package. The unwinding end of the package is usually identified by a rounded edge on the supporting core or bobbin tube, and a yarn transfer tail which is used to connect the beginning of a yarn on one package with the end of a yarn on a successive package, is positioned at the opposite end, i.e. the end opposite the unwinding end.

As noted above, a flattening of the surface area on the end opposite the unwinding end results in improved unwinding properties. In contrast thereto, bulged formations on the unwinding end of the package, have no disadvantageous unwinding consequences. This result was totally unexpected, inasmuch as the opposite result would have been expected from experience with the unwinding behavior of yarns from conical packages.

It should also be noted that the flattening of the cylindrical surface of the cross wound package in accordance with the present invention is not an inclined face, as is obtained in the production of biconical, cross wound packages by uniformly shortening the stroke of the traverse guide. Rather, the flattening is an intentionally produced uniform reduction of the diameter on at least the end of the cylindrical package which is opposite to the unwinding end of the package. Thus in packages which have a transfer tail, a flattened portion is provided on the end of the package where the transfer tail is located. Such packages may be produced in a winding system with means for a periodic contraction and lengthening of the stroke of the traversing yarn guide (i.e. stroke modification), together with a ribbon breaking mechanism. The length of the modified strokes may be substantially decreased, for example, to about 22 mm contraction of the stroke at one or both ends of a basic stroke of the traversing yarn guide of about 250 mm. U.S. Pat. No. 4,325,517 discloses a winding process of this general type.

Packages which are produced in the above manner have however, relatively soft frontal surfaces. Depending on the type of further processing, the soft surfaces are undesirable since they are more easily damaged than hard packages. Thus in many instances, and in particular because of the resulting transport and handling problems, such packages have proven to be undesirable despite their favorable unwinding properties.

In copending and commonly owned U.S. patent application Ser. No. 765,709, now U.S. Pat. No. 4,659,027 a winding method and apparatus is disclosed which maintains the advantage of packages with flattened ends while avoiding unduly soft package ends. Thus a package may be produced having a desirable hardness and with excellent unwinding properties. More particularly the referenced copending application discloses a winding process wherein the yarn traverse guide is controlled to define a series of stroke modification cycles having a sawtooth-like configuration when the end points of the strokes are plotted against time, and wherein a number of stroke modification cycles having a relatively large contraction alternate with cycles having a relatively small contraction. In addition, the speed of the yarn guide may be constantly accelerated and decelerated to avoid undesirable patterns.

In accordance with the present invention, the advantages of packages with flattened ends are maintained. In addition, unduly soft packages are avoided, and a package with a desired controlled hardness together with excellent unwinding properties is produced. Further, the present invention controls the shape of the package, and it is not only possible to avoid the bulges which normally appear on the cylindrical surface of the package, and the invention provides an accurate cylindrical surface in the stroke reversal areas. The present invention thus represents an advance from the method disclosed in U.S. Pat. No. 4,325,517, and copending application Ser. No. 765,709, in which the length of the traverse stroke is varied.

It is accordingly an object of the present invention to provide a method for winding yarns which is adapted to provide substantial uniformity in the package build, and satisfactory unwinding properties.

It is also an object of the present invention to provide a method for winding yarn which is adapted to provide an even mass distribution of the yarn in the stroke reversal area and such that a cylindrical surface is obtained.

It is a further object of the present invention to provide a method for winding a yarn by a variable traverse stroke, and without the need for unduly high accelerations and decelerations of the traverse stroke mechanism.

It is a more particular object of the present invention to provide a method for winding yarns which is adapted to produce a package of relatively large diameter, and yet which insures a satisfactory overhead withdrawal of the yarn at high unwinding speeds, of for example, 1000 m/min or greater, and wherein the package has a stable, cylindrical shape, and which is wound under a uniform tension irrespective of the modified traverse motions and pattern breaking steps.

SUMMARY OF THE INVENTION

These and other objects and advantages of the present invention are achieved in the embodiments illustrated herein by the provision of a method of winding a textile yarn into a package, in which the yarn is cross wound about the package while the yarn is guided onto the package by a traversing yarn guide, and so as to define oppositely directed yarn guide strokes of predetermined length. In accordance with the present invention, the traverse of the yarn guide is controlled at at least one end of the package in a series of stroke modification cycles and wherein in each cycle the length of the strokes of the yarn guide progressively increases and then progressively decreases, and such that a plot of the location of the stroke end points vs. time defines a stroke modification curve of arcuate configuration.

In a preferred embodiment, the traverse speed of the yarn guide is constantly varied between a minimum and maximum value to avoid the development of ribbons, and in addition, the circumferential speed of the package may be concurrently controlled to obtain a substantially uniform yarn tension in the package. In addition, the distance between the minimum and maximum stroke length may be said to define a stroke reversal area at the end of the package, and preferably the method of the invention comprises the further step of controlling the configuration of a stroke modification curve such that the amount of yarn deposited on the package produces a cylindrical surface over the stroke reversal area.

The present invention may be advantageously used to produce cylindrical packages having either straight end surfaces, or inclined end surfaces (biconical packages), when viewed in their longitudinal section.

The method of the present invention is also characterized in that the stroke length changes at the two ends of the package may be of different length, preferably however identical stroke length changes are carried out, and in a constant manner. In so doing, the curve of the stroke modification is of a wave-like form, and preferably proceeds along a curve of generally parabolic form, the apex of which is located on the outermost end point of the traverse stroke, where its inclination is zero.

The reversal of the stroke modification curves at the inner end points may be non-uniform, in that the parabolic segments of the stroke modification curve having a decreasing traverse stroke join the segments of the stroke modification curve having increasing traverse strokes in a cusp at the respective inner end point.

In the present invention, the stroke modification curve is defined by the motion of the end or reversal points of the traverse strokes, with the shortening of the traverse stroke (i.e., the stroke length change) being the ordinate and time the abscissa of the plotted diagram. The stroke length change is a temporary shortening of the traverse stroke relative to the basic traverse stroke, which is carried out at one end of the package, so that in the case of a stroke modification on both ends of the package, the following equations apply:

$2\times$maximum stroke length change$=$maximum traverse stroke$-$minimum traverse stroke, and $2\times$actual stroke length change$=$maximum traverse stroke$-$actual traverse stroke.

The traverse distance between the two outer end points defines the basic traverse stroke, and to produce a biconical package, the traverse stroke is constantly decreased relative to an initial traverse stroke length, the initial traverse stroke length being the longest traverse stroke of the winding cycle, and which is carried out at the beginning of a winding cycle and which defines the length of the package.

As indicated above, the stroke modification curve is in the form of a parabala-like curve on the stroke length vs. time diagram, and this curve is so controlled that the amount of the yarn which is deposited in the reversal area of the traverse motion is uniformly distributed over the reversal area. Thus, a theoretically slightly thickened package end develops at the ends of the package, on which a stroke modification is carried out, but this thickened end does not have the form of a torus as in the past, but it may be essentially cylindrical.

BRIEF DESCRIPTION OF THE DRAWINGS

Some of the objects and advantages having been stated, others will appear as the description proceeds, when taken in conjunction with the following drawings, in which.

DETAILED DESCRIPTION OF THE PREFERRED EMBODIMENTS

Figure 5:
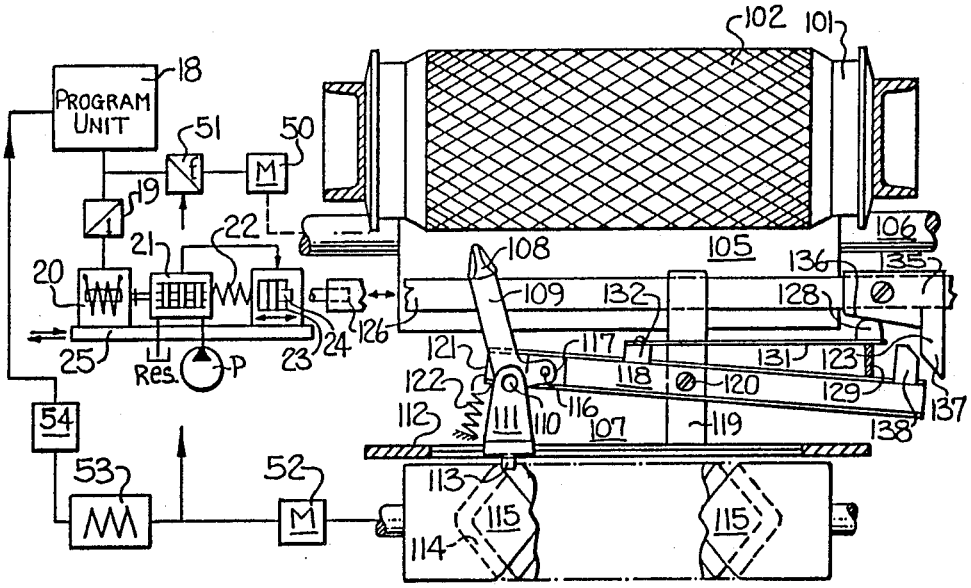
FIG. 5 is a partly schematic front elevation view of a winding apparatus in accordance with the present invention.

Referring more particularly to the drawings, FIG. 5 shows an apparatus for winding a yarn onto a package by the method of the patent invention. In this regard, reference is made to FIG. 3 of U.S. Pat. No. 3,730,448, and essentially identical German Pat. No. 19 16 508. The numerals of FIG. 3 of U.S. Pat. No. 3,730,448 have been increased by 100 for designating identical parts in FIG. 5 of this disclosure. Generally, FIG. 5 illustrates a package 102 which is being wound on bobbin tube 101. The package is driven by friction roller 105 mounted on shaft 106. The shaft is driven by motor 50 via a frequency inverter 51. The traversing mechanism is generally indicated at 107, and comprises a yarn guide 108 mounted on one arm of a toggle lever 109 which is pivotably mounted on pin 110. Pin 110 is fixed to slide 111 which is driven by shoe 113 riding in a helical or spiral groove 114 of cam drum 115. The shoe 113 extends through a slot in the guide plate 112, so that the slide 111 is reciprocated along a direction parallel to this axis of the drum 115 by rotation of the drum. A slide block 117 is pivotally mounted to the order arm of the toggle lever by the pin 116, and a guide rail 118 is provided for receiving the slide block 117. The guide rail 118 is pivotably mounted on pivot axis 120, and a spring 122 extends between one end of the rail and the machine frame for biasing such end in a downward direction.

As will be apparent, the traverse stroke of yarn guide 108 depends on the inclination of guide rail 118. For defining the inclination of guide rail 118, there is provided a cam head 135 which is mounted on a bar 126. Bar 126 preferably serves a series of side-by-side winding stations and has a central drive as further described below. The working surface 136 of cam head 135 acts on the guide rail 118 through the transmission cam 128 and the transmission element 129, and thereby determines the inclined position of the guide rail and hence the length of the traversing stroke. Transmission element 129 serves to produce packages 102 having biconical ends by diminishing the traverse stroke in dependency on the increasing diameter of package 102, and a further description of the element 129 may be obtained from the above-mentioned U.S. Pat. No. 3,730,448. For making packages having flat ends, the guide rail 126 is pulled and adjusted to the left in the manner described below, so that the working surface 137 of cam head 123 cooperates with the shoulder 138 on guide rail 118. In this position, transmission element 129 is out of operation because of the increased inclination of guide rail 118.

The left hand portion of FIG. 5 schematically illustrates a preferred embodiment of means for driving and adjusting the bar 126. This drive means includes a program unit 18, an output-to-current converter 19, and an electromagnet 20, the magnetic force of which is transmitted to hydraulic control valve 21, to a spring 22, and to the cylinder and piston unit 23. The piston rod 24 of the unit 23 is connected to the end of adjusting bar 126. The assembly consisting of magnet 20, control valve 21, spring 22, and cylinder and piston unit 23 is mounted on a support slide 25.

Figure 6:
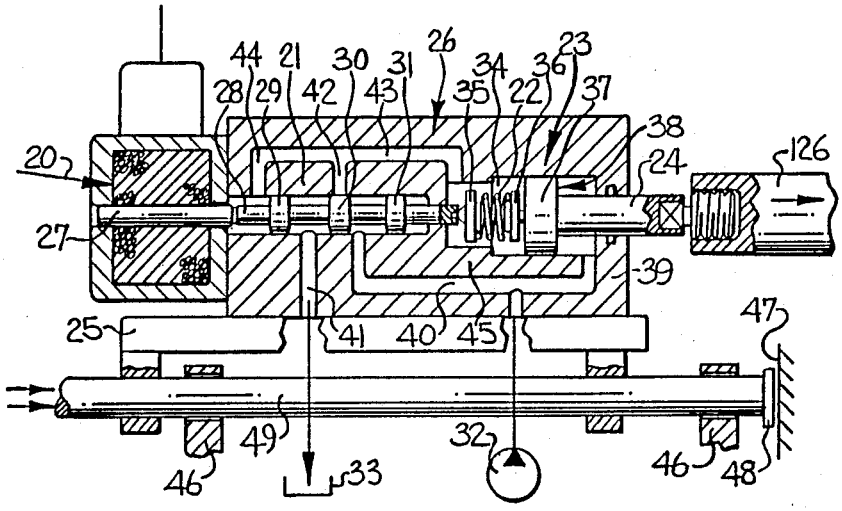
FIG. 6 is a schematic sectional view of the fluid control valve shown in FIG. 5

As seen in FIG. 6, a unitray housing 26 is provided which mounts the electromagnet 20, the hydraulic control valve 21, the spring 22, and the cylinder and piston unit 23. The iron core 27 of magnet 20 acts upon the rod 28 of control valve 21. The rod 28 has three collars 29, 30, 31 for controlling the fluid connections between hydraulic pump 32, reservior 33 and the rear 34 of the cylinder and piston unit 23. The spring 22 acts upon the other side of rod 28 via a suitable support plate 35, and the other end of the spring 22 acts upon support plate 36 and piston 37 of cylinder and piston unit 23. The piston 37 is a differential piston, since the front face 38 is diminished by the area of piston rod 24. The front face 38 of piston 37 is permanently connected by duct 39 to pump 32. The rear 34 of piston 37 is connected to either the pump 32 via duct 40 or to reservior 33 via duct 41. This connection is controlled by movement of collar 30 which connects duct 41 to either one of duct 40 and 42.

One branch 43 of duct 42 leads to the rear 34 of the cylinder and piston unit 23. The other branch 44 serves to equalize the pressure on both sides of the hydraulic control valve. It should be noted that piston 37 in its outer left hand position lies upon a shoulder 45 of the cylinder. Thereby, the outermost stroke ends of the package are mechanically defined.

Figure 7:
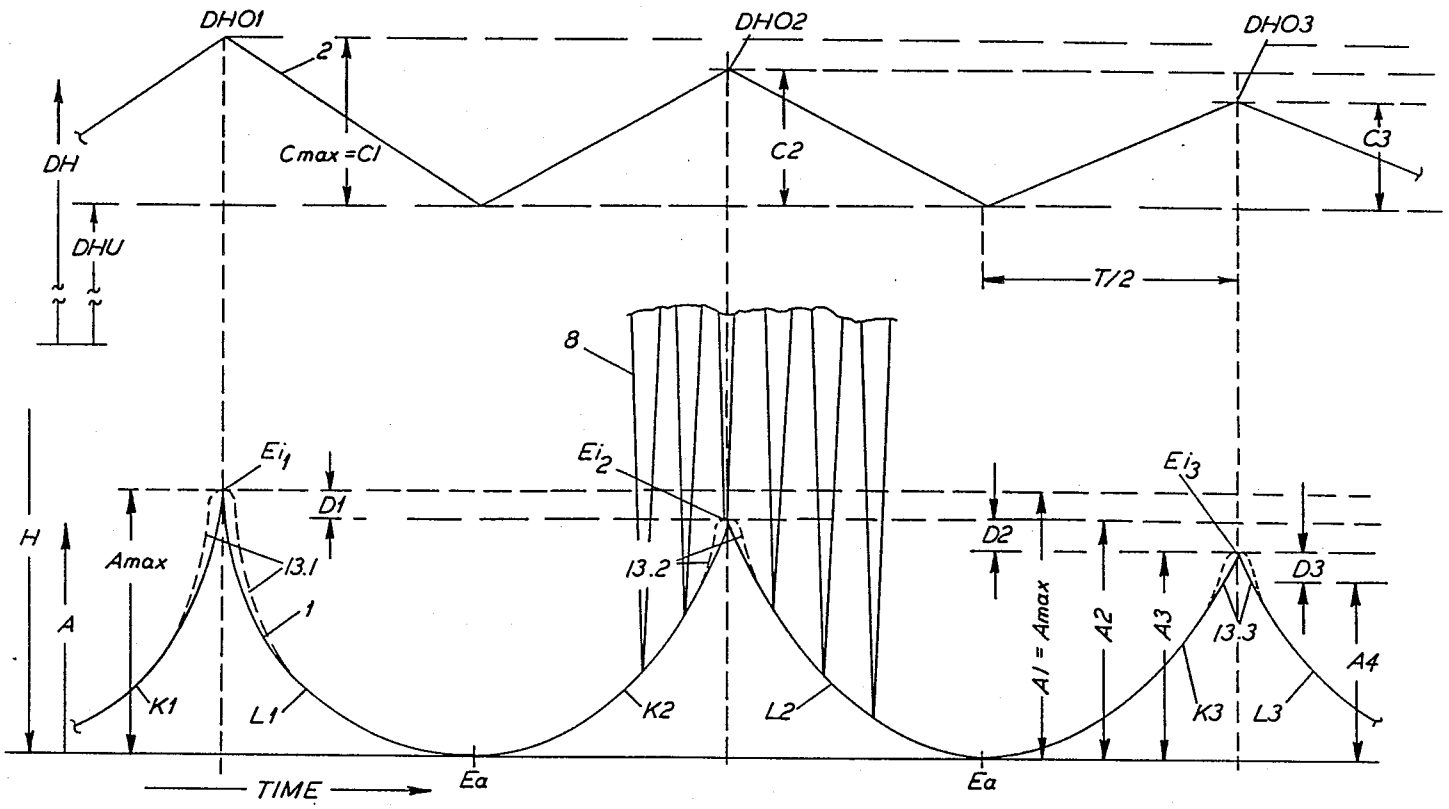
FIG. 7 is a view similar to FIG. 4, and illustrating a further embodiment of the invention.

As also shown in FIG. 7, the housing 26 is supported by a frame 25 which is mounted on two parallel rods 49. The rods 49 are in turn slidably mounted to the supports 46. The frame 25 is movable between two positions, the one being defined by the stop 47, and the other being defined by flange 48 which is adapted to engage the adjacent support 46.

In operation, any of the winding programs as shown in the drawings and diagrams as further described below, may be stored in the program unit 18. The program unit produces an output signal which corresponds to a certain stroke length according to one of the traverse programs provided by this invention. This output signal is transformed by transducer 19 into an electrical current activating the magnet 20. The magnetic force is transmitted to piston rod 28 of control valve 21, to spring 22 and to piston 37 and piston rod 24.

The function of the control means may be described by reference to the position of the control valve 21 as shown in FIG. 7. A certain output signal may be related to a current generating a force on iron core 27 pushing the piston rod 28 with collar 30 into the shown position. In this position, duct 42 is closed. Therefore, the front face 38 of the piston 37 is acted upon by the fluid flow from pump 32, and the rear 34 is closed. Consequently, piston 37 and piston rod 24 are locked in the shown position.

The change of the output signal of program unit 18 causing an increasing current to electromagnet 20 will lead to an increasing force of iron core 27 to the right. Consequently, duct 42 will be opened to duct 41 leading to the reservior 33. This will cause a pressure drop on rear 34 of the cylinder and piston unit 23, and the pump pressure on the front face 38 will shift the piston 37 and rod 24 to the left. Thereby the spring 22 will be compressed and the spring force will tend to shift rod 28 of control valve 21 to the left with a tendency of collar 30 to close duct 42 with respect to the duct 41 and the reservior. Thus, the force generated by the iron core 27 will be balanced by spring 22. If in turn the current is decreased, spring 20 will shift rod 28 to the left, and collar 30 will open duct 42 to branch 40 leading to the pump. Now, the pump pressure will act on both sides of piston 37. Since the active area on rear 34 is greater than active area on front face 38, the piston 37 will be moved to the right. Thereby, spring 22 is expanded and the spring force acting on rod 28 is released. Now, the magnetic force on iron core 27 will have a tendency to move rod 28 to the right and to cause collar 30 to close the connection between duct 42 and pump branch 40.

It will be apparent from the above description that each input current to electromagnet 20 is related to a certain position of the piston 37, rod 24 and consequently to bar 126 and the inclination of the guide rail 118. Thereby, the output of program unit 118 controls the stroke length of yarn guide 108.

As mentioned above, housing 26 is mounted to a frame 25, and in the illustrated position where flange 48 abuts stop 47, the housing 26 and bar 126 are adjusted such that cam head 135 on bar 125 is active to control the inclination of guide rail 118. In this position of frame 25 and housing 26, biconical packages 102 are thus produced. In the other position of the frame 25, where flange 48 abuts support 46, cam head 123 of bar 126 cooperates with shoulder 138 on guide rail 118, and packages 102 having flat ends are produced.

In FIG. 5 it is also indicated that shaft 106 of friction roller 105 is driven by motor 50. Motor 50 is controlled by the output of the frequency converter 51. Cam drum 115 is driven by a motor 52 and the motor 52 is controlled by the program unit 53 which causes a changing traverse motion speed to prevent undesirable pattern formations in the yarn winding. Frequency converter 51 is, on the one hand, controlled by the output signal of program unit 18 representing the stroke modification pursuant to this invention, and on the other hand by the output of program unit 53 representing the change of the traverse motion speed. Thereby, any variation of the tension of the yarn to be wound on package 102 caused by either stroke modification and/or change of traverse motion speed can be compensated by slight fluctuations of the peripheral speed of friction roller 105 and package 102. Timer 54 coordinates the outputs of the program units 18 and 53 for the stroke modification and the traverse speed modification in accordance with this invention, and particularly the above diagrams as further described below.

Figure 4:
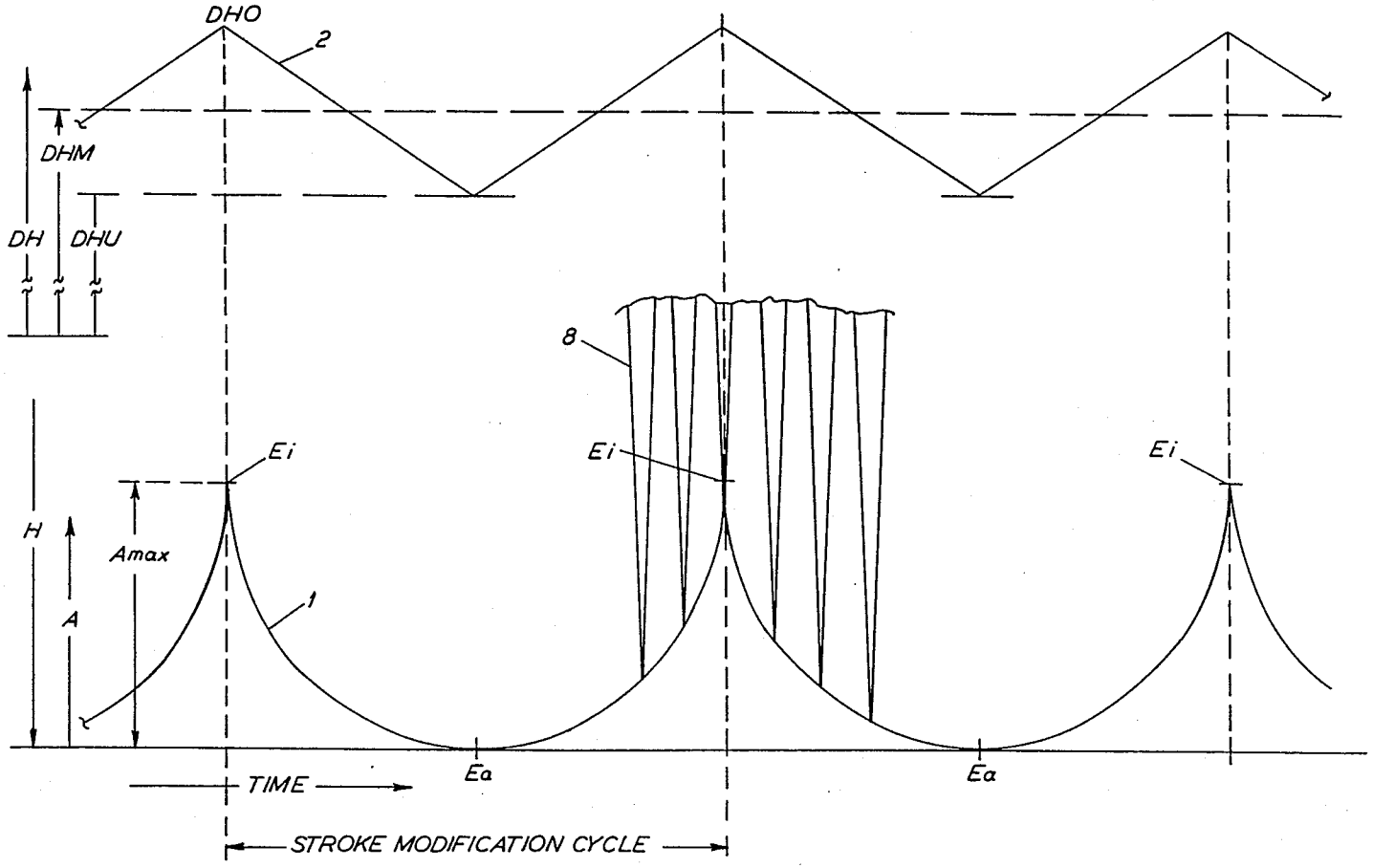
FIG. 4 is a schematic diagram illustrating stroke length vs. time in the upper portion thereof and traverse speed vs. time in the lower portion thereof.

The presently known methods of modifying the stroke apply laws of the stroke modification to produce a zig-zagged, or saw-tooth like pattern. In contrast thereto, the present invention provides for a law of the stroke modification to produce an arcuate, parabola-like curve, as is illustrated for example in FIG. 4. The abscissa of the diagram shown therein represents time, and the ordinate the end area of the traverse stroke H or the stroke length change A. The illustrated curve 1 represents the location of the end points, at which the traversing yarn guide 108 (FIG. 5) reverses at a package end during the course of the winding cycle over time. One partial time interval of the diagram of FIG. 4 illustrates at 8 the time-traverse diagram of the traversing yarn guide 108, it being possible to render only a distorted illustration on the time axis, since the traversing speed is actually faster. As can be seen in the time-traverse diagram 8, the end points at which the traversing yarn guide reverses, are continuously displaced during the course of each stroke modification cycle, to form a parabola-like curve between an apex or maximum stroke Ea and an internal end point or minimum stroke Ei. In the present disclosure, the parabola-like curve 1 is referred to as the "stroke modification curve."

The distance A equals the difference between the maximum stroke Ea and a selected different stroke, and Amax equals Ea−Ei. Amax is thus also defined herein as the "maximum stroke length change" and in one embodiment amounts to 25 mm in a complete stroke modification cycle. The cycle time of a completed stroke modification cycle is typically about 6 seconds.

As can be noted from the diagram of FIG. 4, the stroke modification curve 1 has a zero slope at the apex Ea, and the segments of the stroke modification curve move to the inner end point Ei at a very acute angle. This corresponds to an ideal curve. This ideal curve can be achieved however only when the mechanism illustrated in FIG. 5, i.e., particularly the drive of the guide rail 118, can provide the necessary rapid reversal of the motion. Where this is not possible, the method which is described hereinbelow in conjunction with FIGS. 7–10, may be applied to the present invention.

It should also be noted that, in the illustrated traverse-time diagram of FIG. 4, the descending segments of the stroke modification curve 1 are mirror symmetrical at the apex Ea to the ascending segments. As will appear from the further description hereinbelow, this will be useful, but not necessary, if the modified stroke of the successive stroke modification cycles remains constant.

Before describing the exact course of the stroke modification curve 1 in more detail, there should first be a mention of the synchronization between the stroke modification curve 1 and the ribbon breaking curve 2. The ribbon breaking curve 2 is shown in the upper portion of FIG. 4, with the same abscissa as the time axis, and with the ordinate representing the traverse speed DH. The traverse speed DH is specified as the double stroke rate, which is the number of the reciprocating movements which are performed by the traversing yarn guide 108 (FIG. 5) per unit of time. The tranversing yarn giude 108 is operated at a certain average double stroke rate DHM. This average double stroke rate is related to the surface speed which is imparted to the package by the drive roll 105, and defines the angle at which the yarn is placed on the package. The traverse speed is continuously varied between an upper limiting value DHO and a lower limiting value DHU, for example, according to the linear, sawtooth-shaped law of the ribbon breaking as illustrated. In so doing, the law of the stroke modification curve 1 and the law of the ribbon breaking curve 2 are so synchronized that the lowest traverse speed DHU coincides with the longest traverse stroke Ea of the stroke modification curve, and likewise, the highest traverse speed DHO coincides with the shortest traverse stroke Ei of the stroke modification curve. This will ensure that the variation of the linear traverse speed, which is caused by the stroke modification, is compensated by an oppositely directed curve of the ribbon breaking, and that, as a result, the yarn tension is maintained constant, or is at least very considerably leveled. It should be noted that the average traverse speed remains preferably constant during the course of the winding cycle, but may also be slightly increased or decreased, so as to influence the angle of the yarn deposit during the winding cycle.

Figure 1:
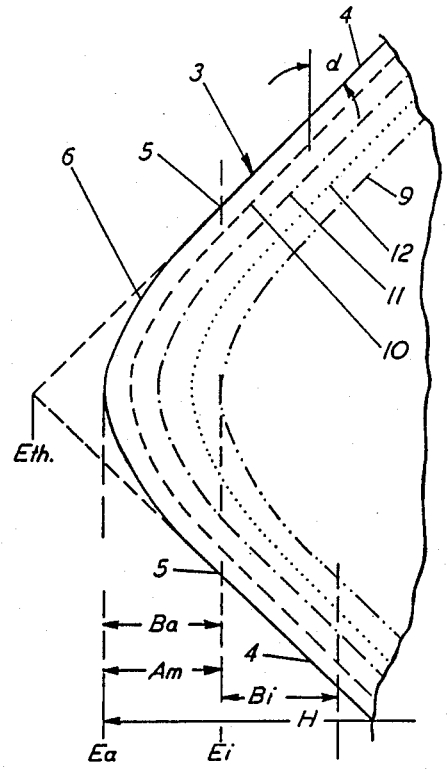
FIG. 1 is a schematic illustration of the traverse motion curves of a single stroke modification cycle in accordance with the present invention.

The determination of the particular course of the stroke modification curve 1 will now be further described with reference to FIGS. 1–3 and 5. As can already be seen in FIG. 5, the groove 114 in the cam drum 115 reverses at the end points of the traverse stroke with a certain curvature. This curvature of the groove is illustrated as the law of motion 3 of the traverse (traverse motion curve) in FIG. 1 at line 4, 6, which represents a development of the cam drum 115. As is shown in FIG. 1, the straight line segment 4 of the traverse motion curve turns into a curved line 6 at a point 5 before and after the stroke reversal. The axial line between the points 5 and the apex or external end point Ea of the traverse stroke, is described as the external reversal area Ba.

When determining the reversal area Ba it should further be considered that the deposit of the yarn on the package is not only governed by the law of the traverse motion, which is predetermined by the form of the cam drum 115. Rather, it should also be considered that the yarn is under a tension when it is placed on the package, and therefore the yarn is not solely deposited under the law of the traverse motion which is determined by the curved drum. In particular, the yarn tends to form in the reversal area along an arc with the smallest possible curvature. The size of the curvature depends on the yarn tension, and it also depends on other yarn parameters, in particular, the friction of the yarn on the wound yarn layers. As a result, the quality of the packages does not only depend on the law of the traverse motion of the cam drum 115, but also, even more, on the actual deposit of the yarn on the package. Therefore, the reversal area Ba is preferably measured on a package as the axial line between the end of the traverse stroke which the cam drum presets for the package end, and the normal plane of the package at which the curved reversal area of the yarn actually wound on the package meets the portion of the yarn which is deposited in a straight line.

The extension of this curve 6 may be parabolic. However, also other, for example sinusoidal, courses of the curve are possible. What matters is that the traversing yarn guide with slide 111 and all parts mounted thereon (FIG. 5) passes through the reversal area Ba with the smallest possible deceleration and acceleration and without jerking. This means that the external end point Ea of the traverse stroke is displaced relative the theoretical end point Eth, at which the straight line segments 4 of the traverse groove would meet an angle, by a certain amount in the axial direction toward the center of the package.

Also illustrated in FIG. 1 is the fact that the traverse motion curve of the yarn guide 108 is now and then returned from the end area toward the center of the package by pivoting the guide rail 118, to produce the stroke modification cycles. Illustrated in FIG. 1 are the axially outermost traverse motion curve with the segments 4 and 6, as well as the axially innermost traverse motion curve 9. Between these two curves are three arbitrarily selected traverse motion curves 10, 11, and 12. These curves are passed through in arbitrarily selected fractions of the cylce time of one modified stroke, i.e., once in each direction of the stroke modification cycle.

The distance between the apex Ea of the axially outermost traverse motion curve and its point of transition 5, at which the straight line segment curve 4 merges into the curved line 6, is, in the present disclosure, described as the reversal area Ba. As is shown in FIG. 1, the modified stroke Am, i.e., the axial distance between the external end point Ea and the internal end point Ei of the traverse stroke, corresponds substantially to the reversal area Ba and is at least equally sized.

According to the present invention, the modified stroke length A is preferably greater than the reversal area Ba, with the reversal area B being the axial length of the package on which the yarn is not wound at a constant angle. This ares is, as the case may be, determined by measurement. The external reversal area Ba is the reversal area in which the yarn has the longest traverse stroke. As will be explained hereinbelow, on the one hand, the reversal area depends on the law of the traverse motion under which the direction of movement of the yarn is reversed at the end of the traverse stroke with a finite deceleration and acceleration, but, on the other hand, also on the yarn tension and friction under which the yarn is wound on the package.

When the traversing yarn guide 108 moves along the axially outermost traverse motion curve with 4, 6, on each unit of the package length, an identical amount of yarn is wound on the straight line segments 4, along which the traverse speed is constant. Thus, a cylindrical layer of yarn is formed. However, on the curved segments 6, the traverse speed decreases first to zero at the outermost end point Ea of the traverse motion curve, and then increases again to the previously described, constant value. Since at a low traverse speed, a larger amount of yarn is deposited on each unit of the package length than at a high traverse speed, a large amount of yarn is deposited at the package end, i.e., in the area of the outermost apex Ea.

The abscissa of the diagram of FIG, 2 represents the length L of the package proceeding from the outermost apex Ea, and the ordinate the thickness of the wound layer, which is, for example, measured in millimeters, and which is wound on the package per unit of time. The curve segment 6.2 illustrates the development of the yarn layer thickness when the traversing yarn guide follows the segments 4, 6 of the traversing motion curve of FIG. 1.

As can be noted from FIG. 1, a parallel displacement of the traverse motion curve occurs as the stroke modification proceeds. Thus, the reversal area Ba is also axially displaced toward the center of the package. This results in that each of the temporary traverse motion curves 9, 10, 11, 12 illustrated in FIG. 1 leads to an associated curve of the deposited layer thickness 9.2, 10.2, 11.2, 12.2. These layers produced per unit of time are illustrated side by side in FIG. 2 as well as in its enlargement FIG. 2A. The diagram of FIG. 3 illustrates a summation of the layers, from which the substance of the invention may be derived.

Figure 2:
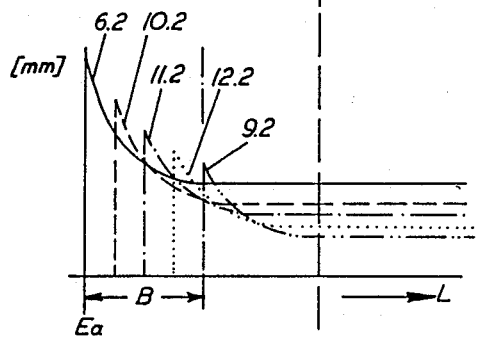
FIGS. 2 and 2A are diagrams representing a plot of package lengths vs. package thickness, with FIG. 2A being an enlargement of FIG. 2.
Figure 3:
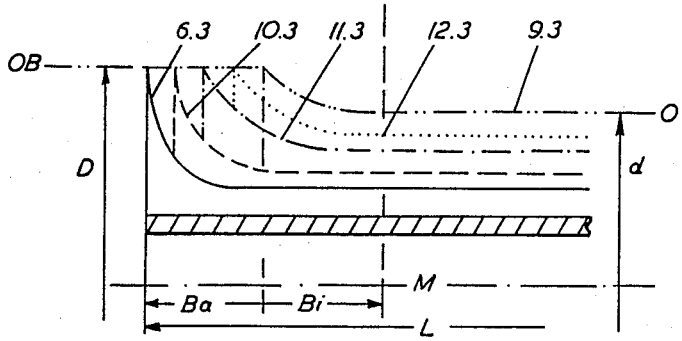
FIG. 3 is a schematic diagram illustrating a summation of the layers in the package end.
Figure 2A:
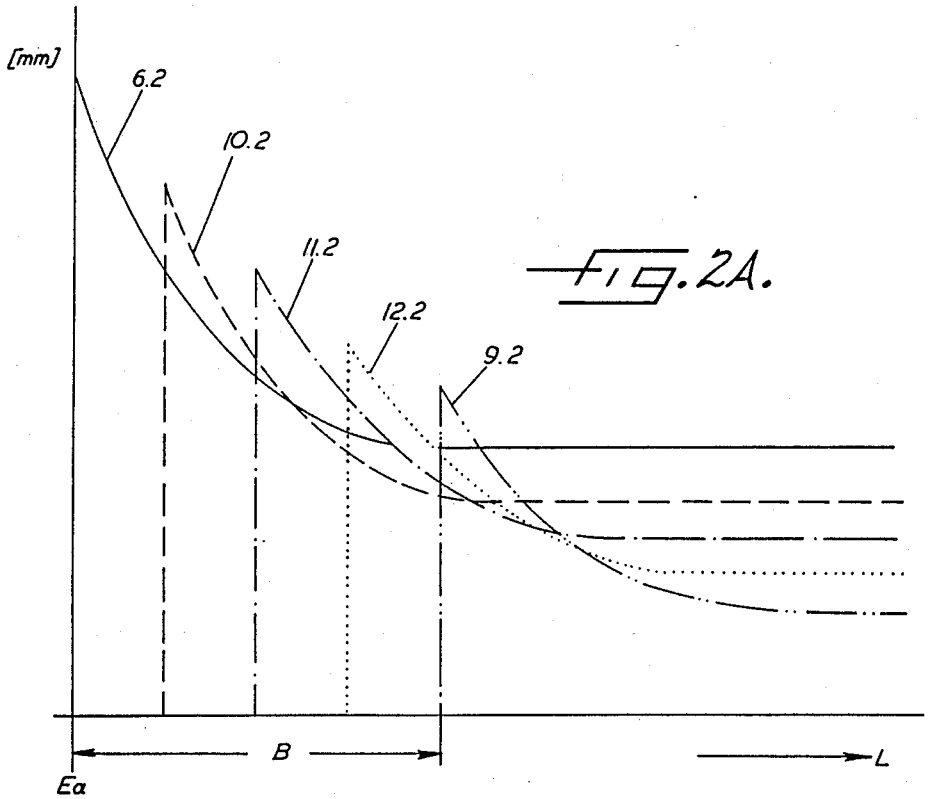

The FIGS. 1-3 are simplified insofar as they only illustrate four individual traverse motion curves of the yarn guide, during a modified stroke, or the layers produced by these courses of the traverse motion curve. However, in reality, all traverse motion curves are passed which are located between the illustrated traverse motion curves 4, 6 and 9. The principle of the invention, however, is better understood when viewing it in steps as illustrated. On the one hand, the maximum modified stroke corresponds substantially to the axial length of the reversal area. On the other hand, the stroke modification curve of FIG. 4 is so determined that the sum of the formed layer thicknesses is constant during the entire modified stroke Amax, and a cylindrical package surface OB is obtained. In FIG. 3, the layer 6.3 is shown, which is produced at the apex of the modified stroke by the traverse motion curve 4, 6 of FIG. 1. By the input of the time, in which this traverse motion curve is passed, i.e., by the input of the slope dA/dT of the stroke modification curve 1 (FIG. 4) at the apex Ea, the thickness of the layer 6.3 is so determined that the maximum located at the package end results in the increased diameter D of the package, which is desired in the reversal area. This applies to the stepwise viewing, but in reality, i.e., with a continuous stroke modification curve, this input results from the curvature of the stroke modification curve at the apex.

The layer 10.3, which is wound on the layer 6., may only become so thick that its maximum reaches, with the underlying layer 6.3, the diameter which is desired in the end area Ba. The layer 10.3 is produced by the traverse motion curve 10. The traverse motion curve 10 is passed for a certain period of time while the traverse stroke decreases (forward travel of the stroke modification), and it is passed for a certain period of time while the traverse stroke increases (return travel of the stroke modification). The period of time for the forward and the return travel of the stroke modification is preferably identical. In this event, the stroke modification curve is, at its apex, mirror symmetrical. The duration of the forward and the return travel of the stroke modification may also be unequal, which will result in an asymmetrical stroke modification curve. In any event, the total duration, which is maintained for the traverse motion curve 10, is predetermined by the maximum diameter D of the previously wound layers of yarn.

As aforesaid, these explanations apply to a simplified, stepwise viewing. During the passage of a continuous stroke modification, this duration corresponds with a certain slope and curvature of the stroke modification curve, which are to be predetermined, at the point of the modified stroke, where the traverse motion curve 10 is traveled. The slope or curvature for the forward and the return travel of the stroke modification may be different in the same manner as the duration.

During the next stroke modification, a layer 11.3 is wound on the layers 6.3 and 10.3, in that the traverse motion curve 11 (FIG. 1) is effected. This traverse motion curve 11 also produces a layer 11.3 with a given thickness. By the input of the times during which the traverse motion curve 11 is followed during the forward and the return travel of the stroke modification, the thickness of the layer 11.3 is so determined that it results, together with the underlying layers 6.3 and 10.3, in the predetermined diameter D of the layers wound over each other during the previous steps of the modified stroke. The same applies now to the traverse motion curve 12 and the thus produced layer 12.3, as well as to the traverse motion curve 9 and thus produced layer 9.3. At this point, the inner end of the stroke modification cycle is reached, and the motion of the stroke modification reverses. As aforesaid, the traverse motion curves 12, 11, 10 are again traveled, and finally the external traverse motion curve 4, 6 is again reached. This method is carried out in a steady form over the entire reversal area Ba, calculated from the outermost apex of the traverse stroke.

As can be seen in FIG. 3, in the stepwise viewing, a package surface with individual, sharp rings theoretically develops in the reversal area Ba. If, however, as is provided by the invention, the stroke modification proceeds steadily, or the steps of the stroke modification are selected to be very small, as would be the case with digital, electronic control, a smooth cylindrical surface is formed having a diameter D, which is slightly greater than the diameter d in the area of the package length with a straight line traverse motion curve.

The stroke modification curve 1 is so computed and controlled that the amount of yarn which is wound per length unit of the package is distributed to a cylindrical form, with the slope and the curvature of the stroke modification curve and the course of the slope being such that the desired distribution of the yarn over the reversal area Ba is exactly met.

As can be noted, the determination of the stroke modification curve 1 will necessarily include the course of the guide groove 114 in the reversal area B. The correction factors which will have to be considered, also include the yarn diameter and other quality parameters of the yarn. These factors can be determined in particular, by tests which indicate the actual distance between the theoretical apex Eth (Fig. 1) of the law of the traverse motion and the actually determined, outermost apex of the yarn deposit on the package.

As indicated in FIG. 3, the increased cylindrical circumference OB terminates in the reversal area Bi, which the yarn guide 108 traverse at the maximum modified stroke, and merges smoothly in the cylindrical circumference O, which is formed in the area with a constant traverse speed.

In the embodiment of FIG. 7, the stroke modification occurs with a variable modified stroke A1, A2, A3, etc., and the ribbon breaking proceeds with a variable amplitude C1, C2, C3, etc. In FIG. 7, the abscissa is the time axis. In the lower portion of FIG. 7, the traverse stroke H or, the changes in stroke length A, is plotted on the ordinate. In the upper portion of FIG. 7, the traverse speed is plotted on the ordinate. The traverse speed is specified as the double stroke rate DH. The double stroke rate is the number of the reciprocating movements of the yarn guide 108 per unit of time (FIG. 5). The traverse speed is continuously varied between the lower, constant limiting value DHU and an upper, variable limiting value DHO, it being possible to apply, as illustrated, a linear, sawtooth-shaped law to the ribbon breaking. Also, as before, the law of the stroke modification 1 and the law of the ribbon breaking 2 are synchronized so that the lowest traverse speed DHU always coincides with the longest traverse stroke at the apex Ea of the stroke modification curve, and the highest traverse speed DHO with the shortest traverse stroke coincides with the inner end point of the stroke modification curve. This synchronization serves to compensate for the fluctuations of the yarn tension, which are caused by the stroke modification, on the one hand, and by the ribbon breaking, on the other. In contrast to the embodiment of FIG. 4, the ribbon breaking proceeds here in such a manner that the upper traverse speed DHO varies, while the lower traverse speed DHU is constant during the winding cycle. Consequently, the average value of the traverse speed does not remain constant during the course of a series of ribbon breaking cycles. As a result, the angle at which the yarn is wound on the package is also changed in its average value. The change, however, is very slight. Perferably, the lower value of the traverse speed DHU remains constant during the winding cycle. However, it is also possible to vary the lower value during the course of the winding cycle, for example, to let it slightly drop, or to let it slightly increase approximately in the first third of the winding cycle, and let it then slightly drop.

A series of four stroke modification cycles are shown in FIG. 7. However, one series may also include more stroke modification cycles, for example, eight. A series of correlated stroke modification cycles is characterized in that the modified stroke length A1 of the first stroke modification cycle equals the maximum modified stroke length, and that the modification stroke lengths A2, A3, etc. of the following cycles is then constantly shortened from one stroke modification cycle to another. The next, directly following series of stroke modification cycles starts again with the maximum modified stroke length A1.

As already noted, the stroke modification curve 1 represents the displacement of the end point of a traverse stroke during a stroke modification cycle. The stroke modification curve typically consists of a lengthening segment L and a shortening segment K. The lengthening segment reflects the course during which the end of the traverse stroke H is lengthened between the internal apex Ei and the external apex Ea, and the shortening segment reflects the shortening of the traverse stroke between the external apex Ea and the internal apex Ei of the traverse stroke H.

The initial portion of the stroke modification curve illustrated in FIG. 7 includes a shortening segment K1 and a lengthening segment L1, wherein the stroke modification curve extends over the maximum modified stroke length Amax. This portion of the stroke modification curve is, in its basic course, that which is illustrated in the solid line, which is designed so that, as already described in conjunction with the diagram of FIGS. 2, 2A, 3 and 4, the thickness of the deposited yarn layer is constant over the entire modified stroke length Amax, and results in a cylindrical package surface. This layer is indicated as Layer 1 in FIG. 9. However, the stroke modification curve is preferably corrected as is shown by the dashed lines 13.1 of the curve. The stroke modification curve is hereby so designed that, in the excess are D1 of the package, which is the difference between the maximum modified stroke length Amax (or A1), and the modified stroke length A2 at the end of the next stroke modification cycle, an additional amount of yarn is wound. This amount of yarn 14.1 forms a layer, which is as thick as the sum of all layers which are wound in the reversal area Ba of the package during the respective series of stroke modification cycles.

The resultant stroke modification curve as indicated by the dashed branch 13.1 of the curve, has the advantage over the ideal form of the curve illustrated in the solid line, in that the shortening segment K1 reverses relatively smoothly to the lengthening segment L1 at the internal end point Ei. This means that, in practice, only moderate decelerations and accelerations are necessary to drive of the stroke modification rod 126 (FIG. 5) and the cylinder-piston assembly 23. It should be noted that the correction 13.1 is ideally limited to the excessive area D1, and that, for practical dynamic reasons, a further correction may be useful. However, the effects of this further correction on the yarn deposits can be kept small.

Figure 9:
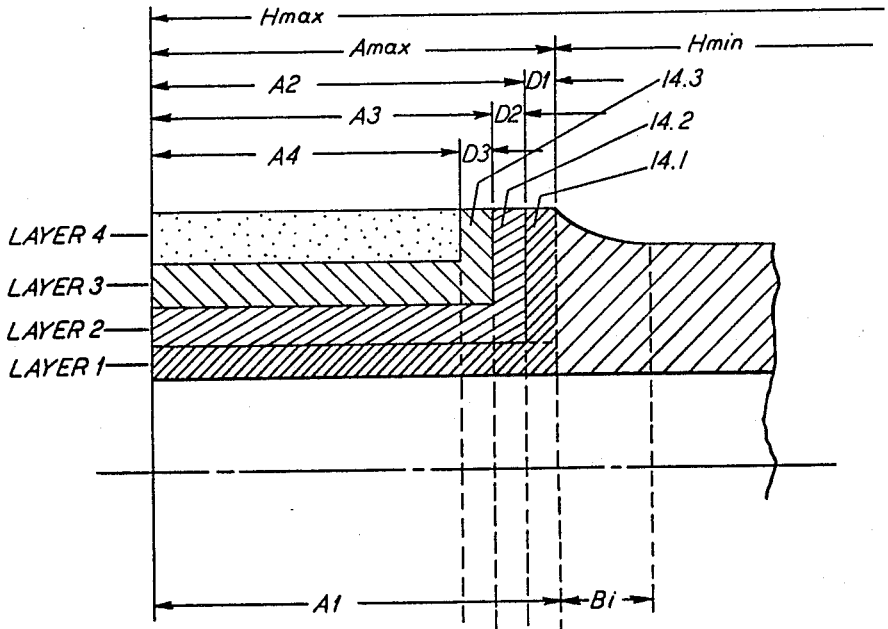
FIGS. 9 and 10 are fragmentary sectional views illustrating the summation of the layers in the package end.

As shown in FIG. 7, the following portion of the stroke modification curve includes a shortened modified stroke A2, consisting of the shortening segment K2 and the lengthening segment L2. The basis for calculating this portion of the curve is again that the yarn is to be uniformly distributed over the area of the modified stroke length A2, i.e. to an equally thick Layer 2 (FIG. 9). However, in so doing, this portion of the curve is also corrected, and, in practice, the dashed line 13.2 of the curve is traversed. This dashed line of the curve is so designed that an additional amount of yarn 14.2 is wound in the axial excessive area D2 of the package between the internal end points Ei2 and Ei3 of the following stroke modification cycle, so that, in the axial area D2 a layer thickness is reached which corresponds to the sum of all layers of the shortened stroke modification cycles which are still to follow within the respective series.

During the next portion of the stroke modification cycle, the stroke is again shortened to stroke length A3. Here again, the shortening segment K3 and the lengthening segment L3 are so designed in their basic course that the amount of yarn wound over the modified stroke length A3 is distributed to a cylindrical Layer 3. In addition, however, an additional amount of yarn 14.3 reaches a thickness of the entire layer which is deposited in the reversal area within the series of the stroke modification cycles.

During the last stroke modification cycle (not shown) of the series, the modified stroke is again shortened to stroke A4, with the stroke modification curve being so designed that a uniformly cylindrical layer is wound over the modified stroke A4.

Subsequently, a new series of modified strokes follows, with the next stroke modification cycle starting with the maximum modified stroke Amax, as shown in FIG. 7, and the modified stroke being again stepwise shortened from one cycle to another.

Figure 10:
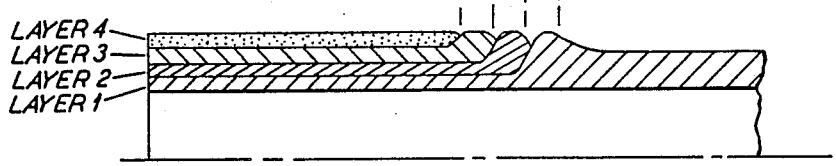

FIGS. 9 and 10 schematically illustrate the buildup of the layers of the end area, with four stroke modification cycles being carried out in one series. As can be seen in FIG. 9, a cylindrical wind is obtained over the stroke modification range Amax, when this modified method is applied, and the winding has a somewhat larger diameter than the winding in the axially central portion of the package. In the reversal area Bi, which follows the maximum modified stroke Amax, the winding with the larger diameter passes smoothly over to the winding with the smaller diameter, and has already been described with reference to FIG. 3.

FIG. 10 shows the formation of the same layers, in a manner which comes closer to actual practice. It should be considered first, that the amount of yarn wound during each stroke modification cycle is small, since each cycle lasts only a few, for example 6, seconds, and second, beacuase of this short duration of a stroke modification cycle, the individual layers and amounts of yarns do not form any sharp edges. The yarn is a linear structure and the individual yarn windings of a layer do not lie close to each other, but are wound at a distance which may amount a few millimeters. Because of this spacing of successive yarn windings, the winding deposited in a subsequent layer will be deposited always between the windings of a previous layer, when the ribbon breaking is operative. Thus, the individual layers do not necessarily have different radii or noticeable difference, and what appears in FIGS. 9 and 10 to be a radially wound yarn layer, becomes in reality to a great extent noticeable only as an increase in the packing density of the package.

As can be seen in FIG. 7, the indicated corrections of the stroke modification curves lead to the fact that the stroke modification motion can be carried out with only moderate deceleration and acceleration. The upper portion of FIG. 7 illustrates that, for the purpose of breaking a ribbon, the traverse speed is increased, starting from the lower double stroke rate DHU, synchronously with the shortening of the traverse stroke H. The upper value of the double stroke rate (DHO2, DHO3, etc.) is decreased likewise relative the upper double stroke rate DHO of the preceding ribbon breaking cycle, in each ribbon breaking cycle and proportionately to each shortening of the modified stroke A1, A2, A3, etc.

In a preferred embodiment of the invention, DHO4, i.e., the smallest upper valve of the double stroke rate within a series of stroke modification and ribbon breaking cycles, is chosen to be large enough that the ratio of the ribbon breaking amplitude C (C=DHO−DHU) to the cycle time T does not fall below a certain, predetermined value. The ribbon breaking amplitude C3 is here the difference between the smallest upper double stroke rate DHO3 and the lower double stroke rate DHU. Half the cycle time T/2 is the duration necessary to increase the double stroke rate from DHU to DHO. The ratio C3: T/2 reflects the smallest slope of the ribbon breaking curves of FIG. 7. This smallest slope must be large enough that two yarn windings which are deposited directly adjacent each other by successive traverse strokes, have a separating distance which at least equals the yarn thickness, when measured perpendicularly to the yarn. In other words, the separating distance in the axial direction of the package must at least be equal to the width of a multifilament yarn when placed on the package. This width of the yarn on the package can be determined by actual measurement.

Another embodiment of the invention will now be explained in conjunction with FIG. 8. The law of the stroke modification and the deposit of the yarn on the resulting package correspond to the description and illustration of the FIGS. 7, 9 and 10. The embodiment of the ribbon breaking of the upper portion of FIG. 8 corresponds to the illustration and description of the upper portion of FIG. 4, i.e., the ribbon breaking amplitude is constant.

Proceeding from the fact that with a constant ribbon breaking amplitude, the upper value of the double stroke rate DHO is so determined that it results in an ideal compensation of the yarn tension at the maximum modified stroke length, it can be concluded that in this embodiment, there will not be a complete compensation of the yarn tension at the shortest modified stroke length. For this reason, as shown in the lower portion of FIG. 8, the circumferential speed of the package is increased synchronously with the stroke modification or the breaking, respectively. During the stroke modification cycle with the maximum modified stroke Amax, the rotational speed of the package equals the initial value VAO. Synchronously with the beginning of the portion of the stroke modification cycle with a shortened modified stroke A2, the rotational speed V of the package is also slightly increased, the difference between V2 and V1 being proportional to the difference of the modified strokes A1 and A2. Then, as the traverse stroke lengthens, the rotational speed is again decreased to its initial value VAO=V1. As the next stroke modification cycle is carried out, the rotational speed is again increased to a higher value V3. The difference V3−V1 is again proportional to the total shortening of the modified strokes Amax−A3. By the input of a suitable initial value of the rotational speed V1 of the package and of the increased values V2 and V3, which are to be determined by calculation and test, a complete compensation of the yarn tension can be brought about, so that the tension to which the yarn is subjected on the package does not fluctuate during the winding cycle.

Figure 8:
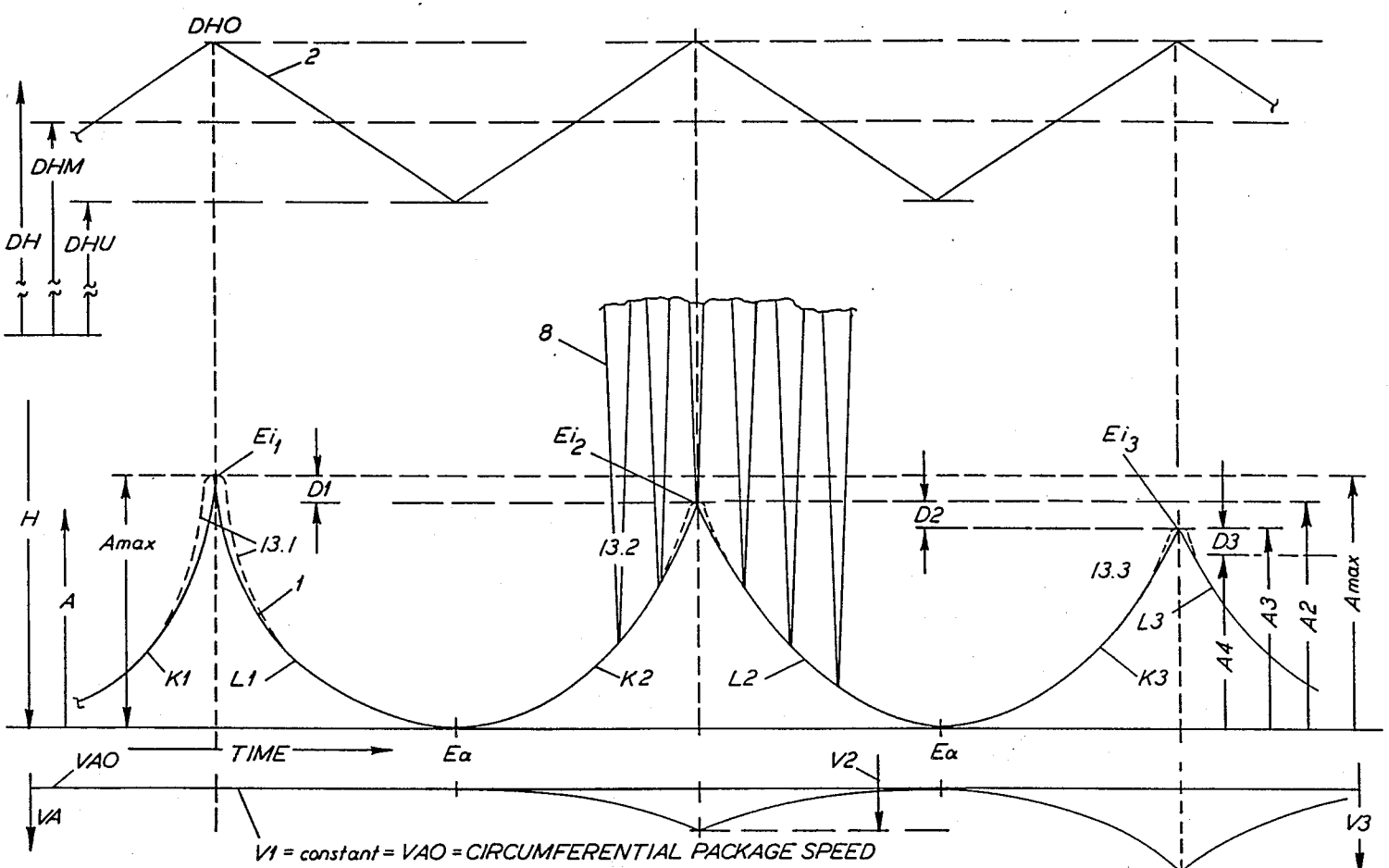
FIG. 8 is a view similar to FIG. 4, and illustrating a further embodiment of the invention, and further including a schematic diagram of circumferential package speed vs. time in the lower portion thereof.

As can be seen, the method of the lower portion of FIG. 8 can also be combined with a method of the FIG. 7. This can be done with advantage, when no acceptable compromise can be found between the requirement of a good ribbon breaking and the requirement of a compensation of the yarn tension.

Figure 11:
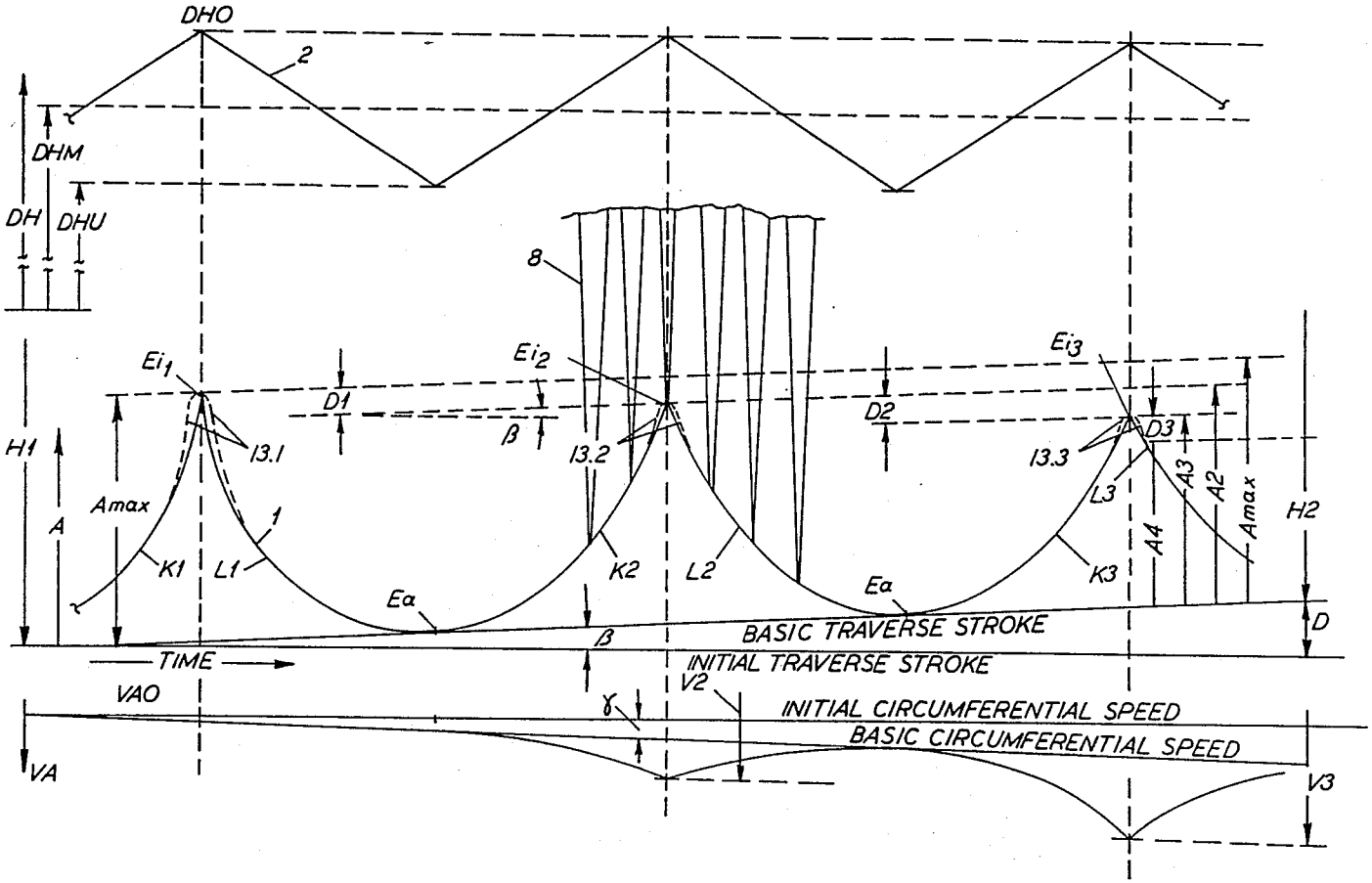
FIG. 11 is a view similar to FIG. 8, and illustrating a further embodiment of the present invention.

Another embodiment of the present invention is illustrated in FIG. 11. The embodiment of the ribbon breaking of FIG. 11 corresponds to the illustration and description of FIG. 4, i.e., the ribbon breaking amplitude is constant. However, it should be initially noted that the method of FIG. 11, which is described hereinbelow, can also be utilized with a ribbon breaking method of FIG. 7. The possibility of varying the ribbon breaking amplitude will be applied in particular when this is needed for a compensation of the yarn tension. To this extent, reference is made to the description of the upper portion of FIG. 4.

Utilizing the diagram of the traverse motion as illustrated in FIG. 11, a biconical winding is produced. At the beginning of the winding cycle the yarn is displaced with the initial traverse stroke H1. As the winding cycle proceeds, the traverse stroke H is constantly decreased on both ends of the package. As a result, a cylindrical package is formed with flattened, i.e., conical front end surfaces. The difference of the axial winding length between the initial winding and the final winding is indicated at D. This means that the basic traverse stroke decreases constantly during the course of the winding cycle. The stroke modification proceeds from this decreasing basic traverse stroke.

The stroke modification occurs with a variable stroke A1, A2, A3, etc. In FIG. 11 the abscissa is the time axis. In the upper portion of FIG. 11, the traverse speed is plotted on the ordinate. The traverse speed is specified as the double stroke rate DH. The double stroke rate is the number of the reciprocating movements of the yarn guide 108 (FIG. 5) per unit of time. The traverse speed is continuously varied between a lower, constant limiting value DHU and an upper, variable limiting value DHO, it being possible to apply a linear, sawtooth-shaped law of the ribbon breaking, as illustrated. Likewise, as before, the law of the stroke modification curve 1 and the law of the ribbon breaking are so synchronized that the lowest traverse speed DHU always coincides with the longest traverse stroke at the apex Ea of the stroke modification curve, and the highest traverse speed DHO coincides with the shortest traverse stroke in the inner end point of the stroke modification curve. This synchronization serves to compensate for the fluctuations of the yarn tension, which are caused by the stroke modification, and by the ribbon breaking.

In the middle portion of FIG. 11, the traverse stroke H or, respectively, the modified stroke length A is plotted on the ordinate. As can be seen, the basic traverse stroke is constantly varied relative the initial traverse stroke. In the diagram of FIG. 11, the basic traverse stroke forms a straight line at an angle beta. During the course of a stroke modification cycle, the maximum traverse stroke, and the modified strokes A1–A4 are calculated based on this basic traverse stroke.

FIG. 11 illustrates two complete stroke modification cycles of a series of four cycles. A series may, however, include more, for example, eight stroke modification cycles. The series of correlated stroke modification cycles is characterized in that the modified stroke lenght A1 of the first stroke modification cycle equals the maximum, modified stroke, and that the modified stroke A2, A3, etc. of the following cycles is then shortened from one stroke modification cycle to another. The next, directly following series of stroke modification cycles starts again with the maximum modified stroke.

As previously noted, the stroke modification curve 1 represents the shortening of the traverse stroke relative the basic traverse stroke during a stroke modification cycle. Typically, the stroke modification curve consists of a lengthening segment L and a shortening segment K. The lengthening segment represents the time in which the end of the traverse stroke H is lengthened between the inner end Ei and the outer apex Ea, which lies on the basic traverse stroke line. The shortening segment reflects the shortening of the traverse stroke between the external apex Ea, and the internal apex Ei of the traverse stroke H. Also, one lengthening segment and one shortening segment is associated with each stroke modification cycle.

The initial portion of the stroke modification curve illustrated in FIG. 11 includes a shortening brance K1 and a lenghtening brance L1. The stroke modification curve extends over the maximum, modified stroke Amax. The stroke modification curve of this portion of the curve is so designed as to its course, which is shown as a solid line, that, as noted above in conjunction with the diagram of FIGS. 2, 2A, 3 and 4, the thickness of the wound yarn layer is constant over the entire modified stroke Amax, and results in a cylindrical package surface. This layer is indicated as Layer 1 in FIG. 12. However, the stroke modification curve 13.1 is so designed that, in the axial excess area D1 of the package, which is the difference between the maximum, modified stroke Amax (or A1) and the modified stroke A2 of the next stroke modification cycle, an additional amount of yarn 14.1 is wound. This amount of yarn 14.1 forms a layer, which is as thick as the sum of all layers, which are wound in the reversal area Ba of the package during the respective series of stroke modification cycles.

The resultant stroke modification curve indicated by the dashed curve 13.1 has the advantage over the ideal, solid-line curve, in that the shortening branch K1 reverses relatively smoothly to the lengthening branch L1 at the inner end point Ei. This means that only moderate decelerations and accelerations are needed for the drive of the stroke modification rod 126 (FIG. 5). It should be noted that, ideally, the corrected curve 13.1 is limited to the excess area D1, and that for practical, dynamic reasons, however a further correction may be useful under certain circumstances. The effect of this further correction on the yarn deposit, however, may be kept small.

Figure 12:
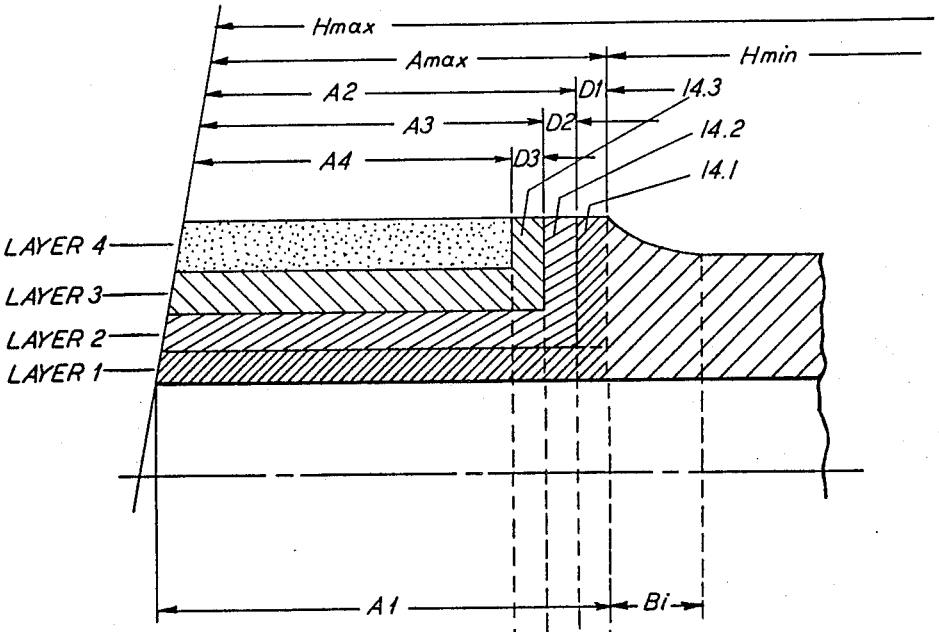
FIGS. 12 and 13 are views similar to FIGS. 9 and 10 respectively, and illustrating a further embodiment of the invention.

As shown in FIG. 11, the following portion of the stroke modification curve is carried out with a shorter, modified stroke A2, and consists of the shortening segment K2 and the lengthening segment L2. The basis for the calculation of this curve is again the given requirement to distribute the yarn uniformly over the range of the modified stroke A2, i.e. to wind it to an equally thick Layer 2 (FIG. 12). In so doing, this curve is also corrected, and in practice, the dashed curve 13.2 is traversed. This dashed curve is so designed that, in the axial excess area D2 of the package, an additional amount of yarn 14.2 is wound between the inner end points Ei2 and Ei3 of the following stroke modification cycle, in such a manner, that a layer thickness is reached in the axial area D2, which corresponds to the sum of all layers of the still following, shorter modification cycles of the respective series.

During the next portion of the stroke modification curve, the modified stroke is again shortened to stroke lenght A3. Here again, the basic course of the shortening segment K3 and the lengthening segment L3 is so designed that the disposited yarn is distributed to a cylindrical Layer 3 over the modified stroke lenght A3. However, in addition, an additional amount of yarn 14.3 is wound in the excess area D3 of the package (FIG. 12), and the correction 13.3 of the stroke modification curve again occurs, as is shown in dashed lines. The additional amount of yarn 14.3 also reaches a layer thickness of the entire yarn which is deposited in the reversal area within the series of stroke modification cycles.

During the last stroke modification cycle (not shown) of the series, the modified stroke is again shortened to A4, with the stroke modification curve being so designed that a uniformly cylindrical layer is wound over the modified stroke A4. Subsequently, a new series of modified strokes follows, with the next cycle starting again with the maximum, modified stroke length Amax, as is shown in FIG. 11, and the modified stroke being again shortened in steps from one cycle to another.

Figure 13:
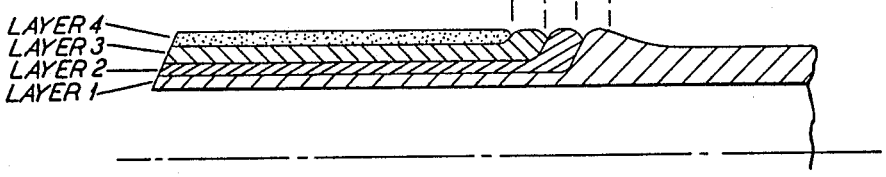

FIGS. 12 and 13 illustrate the build of the layers in the end area, with four stroke modification cycles being carried out during one series. As can be seen in the schematic view of FIG. 12, the shortening of the basic traverse stroke relative the initial traverse stroke leads to sloped end surface of the package, i.e., a conical wind. It should, however, be noted that the angle of the cone is exaggerated in the FIGS. 12 and 13. In reality, the basic traverse stroke does not vary to that extent during a stroke modification cycle, which lasts only a few seconds.

As can be seen in the schematic view of FIG. 12, the modified method achieves a cylindrical wind over the range of the stroke modification Amax, which has a somewhat larger diameter than the wind in the central area of the package. In the reversal area Bi, which follows tha maximum modified stroke length Amax, the wind with a larger diameter passes smoothly over to a wind with a smaller diameter, as previously described in conjunction with FIG. 3. FIG. 13 illustrates the formation of the layers which are schematically shown in FIG. 12, and in a manner which comes closer to actual practice. Also in FIG. 13, the angle of the slope of the front end is exaggerated.

Within the framework of the present application, it should be considered that, on the one hand, the amount of yarn wound during each stroke modification cycle is small, since each cycle lasts only a few, for example, six, seconds. One the other hand, it should be considered that no sharp edges of the individual layers and amounts of yarn develop due to this short duration of a stroke modification cycle. The yarn is a linear structure, and the individual yarn windings of a layer do not lie close to each other, but are at a distance which may amount to several millimeters. Because of this yarn spacing of successive windings, the windings which are deposited in a subsequent layer, are always placed between the windings of a preceding layer when the ribbon breaking is operative, so that the individual layers do not necessarily have different radii or radii of noticeable difference. What appears in FIGS. 12 and 13 to be a radially wound layer of yarn, becomes in reality to a great extent only noticeable as an increase in the packing density of the package.

As can be seen in FIG. 11, the correction of the stroke modification curves leads in all cases to the fact that the modification motion can be carried out with moderate deceleration and acceleration.

As is shown in the upper portion of FIG. 7, the traverse speed could be increased for the purpose of breaking a ribbon, starting from the lower double stroke rate DHU, synchronously with the shortening of the traverse stroke H, with the upper double stroke rate DHO2, DHO3, etc. in each ribbon breaking cycle being decreased likewise proportionately to each shortening of the modified stroke A1, A2, A3, etc. and relative the double rate DHO of a preceding ribbon breaking cycle. If, however, the stroke modification method is carried out with a constant ribbon breaking, as is shown in the upper portion of FIG. 11, it may be advantageous to also vary the circumferential speed for the purpose of compensating for fluctuations of the yarn tension, as is shown in the lower portion of FIG. 11. To this end, the circumferential speed is first increased synchronously with the decreasing basic traverse stroke relative the initial value of the circumferential speed VAO. This constantly increasing circumferential speed is illustrated in the diagram of the lower portion of FIG. 11, in which the ordinate represents the circumferential speed of the package indicated by "basic circumferential speed." A further modification follows according to the invention.

If one proceeds, in the case of a constant ribbon breaking amplitude from the fact that the upper value of the double stroke rate DHO is so rated that it results in an ideal compensation of the yarn tension, it will result therefrom that no complete compensation of the yarn tension occurs during the shortest, modified stroke. As a result, the circumferential speed of the package is increased in the embodiment of the lower portion of FIG. 11 synchronously with the stroke modification or, respectively, the ribbon breaking, and also relative to the basic circumferential speed. During the stroke modification cycle with the maximum, modified stroke length Amax, the circumferential speed of the package equals the basic circumferential speed. Synchronously with the start of the portion of the stroke modification curve with a shortened, modified stroke length A2, a slight increase in the circumferential speed V of the package occurs, the difference between V2 and V being proportionate to the difference of the modified strokes A1 and A2. Then, as the traverse stroke is lengthened, the circumferential speed is again reduced to the basic circumferential speed. As the next stroke modification cycle proceeds, the circumferential speed is again increased to an increased value V3. The difference V3—V1 is again proportional to the total shortening of the modified stroke Amax—A3. The input of a suitable initial value and basic value V1 of the circumferential speed of the package and of the increased values V2 and V3, which input is to be determined by calculation and test, permits a complete compensation of the yarn tension to be achieved, so that the tension to which the yarn is subjected on the package does not fluctuate either during the winding cycle, or during a series of stroke modification cycles, or during a stroke modification cycle.

In the drawings and specification, there has been set forth a preferred embodiment of the invention, and although specific terms are employed, they are used in a generic and descriptive sense only and not for purposes of limitation.

I claim:

1. In a method of winding a textile yarn into a package in which the yarn is cross wound about the package while the yarn is guided onto the package by a traversing yarn guide so as to define oppositely directed yarn guide strokes of predetermined length, the improvement therein comprising controlling the traverse of the yarn guide at at least one end of the package in a series of stroke modification cycles, and including in each cycle the steps of progressively increasing the length of the strokes of the yarn guide and then progressively decreasing the same, such that the distance between the minimum and maximum stroke lengths defines a stroke reversal area at said at least one end of the package, and such that a plot of the location of the stroke end points vs. time defines a stroke modification curve of arcuate configuration, and controlling the configuration of the stroke modification curve such that the same amount of yarn is deposited at each point along the length of said stroke reversal area, so that a package having a cylindrical surface along said stroke reversal area is produced.

2. The method as defined in claim 1 wherein the step of controlling the traverse of the yarn guide includes controlling the extent of the increase and the extent of the decrease of the length of the strokes so as to be the same in successive stroke modification cycles.

3. The method as defined in claim 1 wherein the step of controlling the traverse of the yarn guide includes changing the extent of the change in stroke length so as to be different between selected cycles.

4. the method as defined in claim 1 wherein the step of controlling the traverse of the yarn guide further includes decreasing the stroke length less than the stroke length is increased in each of a series of stroke modification cycles, and such that the extent of the change in stroke length decreases progressively in said series of cycles.

5. The method as defined in claim 4 wherein the initial stroke modification cycle of said series defines a maximum stroke length change, and comprising the further step of increasing the change in stroke length to said maximum stroke length change in the cycle following said series of cycles, and repeating the above steps which resulted in said series of stroke modification cycles and such that the extent of the change in stroke length decreases progressively in a following like series of cycles.

6. The method as defined in claim 1 including the step of progressively decreasing the maximum length of the yarn traverse strokes over the entire build of the package and so as to produce a biconical package.

7. The method as defined in claim 1 comprising a further step of repeatedly varying the traverse speed of the yarn guide between a minimum value and a maximum value.

8. The method as defined in claim 7 wherein in each of said cycles, the maximum value of the varying traverse speed occurs during the time of minimum stroke length, and the minimum value of the varying traverse speed occurs during the time of the maximum stroke length, and so as to compensate for variations in yarn tension in the package.

9. The method as defined in claim 1 wherein said steps of progressively increasing and progressively decreasing the length of the strokes are controlled such that the stroke modification curve is smoothly curved to approximate a parabola.

10. The method as defined in claim 1 comprising the further step of controlling the speed of the traversing yarn guide so that its speed is essentially uniform across a medial portion of the length of the package, and such that a cylindrical surface is produced along said medial portion which has a diameter somewhat less than the diameter of the cylindrical surface which is formed over the stroke reversal area.

11. The method as defined in claim 1 wherein the extent of the change in stroke length decreases in a series of successive cycles, and wherein the difference in the extent of change in stroke length between successive cycles defines respective shortened stroke lengths (D), and further controlling the configuration of the stroke modification curve of each cycle such that the layers of yarn deposited on the package consist of (a) a cylindrical layer over the stroke reversal area of said cycle, and (b) an added layer within said shortened stroke length, the thickness of which corresponds to the thickness of the cylindrical layers of all successive stroke modification cycles in said series.

12. The method as defined in claim 1 comprising the further step of controlling the circumferential speed of the package during at least some of the stroke modification cycles, and including increasing the circumferential speed to a maximum value at the time of minimum stroke length, and decreasing the circumferential speed to a minimum value at the time of maximum stroke length.

13. The method as defined in claim 12 comprising a further step of repeatedly varying the traverse speed of the yarn guide between a minimum value and a maximum value, with the maximum value of the varying traverse speed occurring during the time of the minimum stroke length, and so as to compensate for variations in yarn tension in the package.

* * * * *

UNITED STATES PATENT AND TRADEMARK OFFICE

CERTIFICATE OF CORRECTION

PATENT NO. : 4,913,363

DATED : April 3, 1990

INVENTOR(S) : Friedhelm Lenz

It is certified that error appears in the above-identified patent and that said Letters Patent is hereby corrected as shown below:

Column 5, line 29, "order" should be -- other --

Column 6, line 1, "unitray" should be -- unitary --

Column 6, line 26, "FIG. 7" should be -- FIG. 6 --

Column 6, line 45, "FIG. 7" should be -- FIG. 6 --

Column 9, line 57, "cylce" should be -- cycle --

Column 12, line 20, "traverse" should be -- traverses --

Column 14, line 46, "beacuase" should be -- because --

Column 14, line 65, "purpose" should be -- purposes --

Column 15, line 8, "valve" should be -- value --

UNITED STATES PATENT AND TRADEMARK OFFICE

CERTIFICATE OF CORRECTION

PATENT NO. : 4,913,363

DATED : April 3, 1990

INVENTOR(S) : Friedhelm Lenz

It is certified that error appears in the above-identified patent and that said Letters Patent is hereby corrected as shown below:

Column 17, line 23, "brance" should be -- branch --

Column 17, line 24, "brance" should be -- branch --

Column 18, line 43, "tha" should be -- the --

Column 19, line 5, after "the" insert -- stroke --

In the Abstract:

Line 8, "durin" should be -- during --

Signed and Sealed this

Seventeenth Day of March, 1992

*Attest:*

HARRY F. MANBECK, JR.

*Attesting Officer*

*Commissioner of Patents and Trademarks*